US006437655B1

(12) United States Patent
Andoh et al.

(10) Patent No.: US 6,437,655 B1
(45) Date of Patent: Aug. 20, 2002

(54) METHOD AND APPARATUS FOR AUTOMATICALLY ADJUSTING THE CHARACTERISTICS OF A DIELECTRIC FILTER

(75) Inventors: Masamichi Andoh, Kyoto; Kazuhiko Kubota, Mukou, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/437,061

(22) Filed: Nov. 9, 1999

(30) Foreign Application Priority Data

Nov. 9, 1998 (JP) ..... 10-317322

(51) Int. Cl.[7] ..... H01P 1/20
(52) U.S. Cl. ..... 333/17.1; 333/202; 333/235
(58) Field of Search ..... 333/17.1, 235, 333/202, 219.1

(56) References Cited

U.S. PATENT DOCUMENTS

| | | | | |
|---|---|---|---|---|
| 5,235,294 A | * | 8/1993 | Ishikawa et al. | 333/235 X |
| 5,528,204 A | * | 6/1996 | Hoang et al. | 333/134 |
| 5,710,530 A | | 1/1998 | Wada et al. | 333/219.1 |
| 5,796,320 A | * | 8/1998 | Hattori et al. | 333/219.1 |
| 6,072,378 A | * | 6/2000 | Kurisu et al. | 333/219.1 |
| 6,097,263 A | * | 8/2000 | Mueller et al. | 333/235 X |
| 6,147,577 A | * | 11/2000 | Cavey | 333/202 |

FOREIGN PATENT DOCUMENTS

| | | |
|---|---|---|
| JP | 9312509 | 12/1997 |
| JP | 9-326615 | 12/1997 |

OTHER PUBLICATIONS

Korean Examination Report dated Dec. 19, 2001, along with an English translation.

* cited by examiner

*Primary Examiner*—Robert Pascal
*Assistant Examiner*—Stephen E. Jones
(74) *Attorney, Agent, or Firm*—Ostrolenk, Faber, Gerb & Soffen, LLP

(57) ABSTRACT

A method and an apparatus for exactly and automatically adjusting the characteristics of a dielectric filter in a short time period. The characteristic parameters of a dielectric filter are measured, electric parameters of a designed equivalent circuit of the filter are calculated with the use of characteristic parameters, characteristic adjusting portions of the dielectric filter are adjusted, while at the same time, adjustment functions indicating the variation amounts of electric parameters with respect to adjusting amounts are calculated with the use of the electric parameters and the adjusting amounts which have been changed by the above adjustment. Then, in accordance with simultaneous equations involving adjustment functions, an adjusting amount is calculated with the use of a difference between a present electric parameter and a desired electric parameter, thereby effecting an adjustment which is for example 50%. By repeatedly conducting the above treatments, the characteristic parameters of the filter will be allowed to successively get closer to the desired values.

16 Claims, 12 Drawing Sheets

| DESIGNED PARAMETER | EXPLANATION | RESONATOR 1 | RESONATOR 2 |
|---|---|---|---|
| F1 | FREQUENCY OF THE FIRST STAGE | f1 | — |
| F2 | FREQUENCY OF THE SECOND STAGE | f2 | — |
| F3 | FREQUENCY OF THE THIRD STAGE | f3 | — |
| F4 | FREQUENCY OF THE FOURTH STAGE | — | f1 |
| F5 | FREQUENCY OF THE FIFTH STAGE | — | f2 |
| F6 | FREQUENCY OF THE SIXTH STAGE | — | f3 |
| K01 | COMBINATION COEFFICIENT BETWEEN AN INPUT LOOP AND THE FIRST STAGE | — | — |
| K12 | COMBINATION COEFFICIENT BETWEEN THE FIRST STAGE AND THE SECOND STAGE | k12 | — |
| K23 | COMBINATION COEFFICIENT BETWEEN THE SECOND STAGE AND THE THIRD STAGE | k23 | — |
| K34 | COMBINATION COEFFICIENT BETWEEN THE THIRD STAGE AND THE FOURTH STAGE COMBINATION COEFFICIENT BY VIRTUE OF A COMBINATION LOOP | — | — |
| K45 | COMBINATION COEFFICIENT BETWEEN THE FOURTH STAGE AND THE FIFTH STAGE | — | k12 |
| K56 | COMBINATION COEFFICIENT BETWEEN THE FIFTH STAGE AND THE SIXTH STAGE | — | k23 |
| K67 | COMBINATION COEFFICIENT BETWEEN THE SIXTH STAGE AND AN OUTPUT LOOP | — | — |
| K03 | COMBINATION COEFFICIENT BETWEEN THE INPUT LOOP AND THE THIRD STAGE | — | — |
| K13 | COMBINATION COEFFICIENT BETWEEN THE FIRST STAGE AND THE THIRD STAGE | k13 | — |
| K46 | COMBINATION COEFFICIENT BETWEEN THE FOURTH STAGE AND THE SIXTH STAGE | — | k13 |
| K47 | COMBINATION COEFFICIENT BETWEEN THE FOURTH STAGE AND THE OUTPUT LOOP | — | — |
| K07 | COMBINATION COEFFICIENT BETWEEN THE INPUT LOOP AND THE OUTPUT LOOP | — | — |
| Q1 | Q OF THE FIRST STAGE | Q OF f1 | — |
| Q2 | Q OF THE SECOND STAGE | Q OF f2 | — |
| Q3 | Q OF THE THIRD STAGE | Q OF f3 | — |
| Q4 | Q OF THE FOURTH STAGE | — | Q OF f1 |
| Q5 | Q OF THE FIFTH STAGE | — | Q OF f2 |
| Q6 | Q OF THE SIXTH STAGE | — | Q OF f3 |

FIG. 10

METHOD AND APPARATUS FOR AUTOMATICALLY ADJUSTING THE CHARACTERISTICS OF A DIELECTRIC FILTER

BACKGROUND OF THE INVENTION

1. Field of the Invention

The present invention relates to a method of and an apparatus for automatically adjusting the characteristics of a dielectric filter.

2. Description of the Related Art

Typical dielectric filters are composed of electromagnetically coupled dielectric resonators. Each resonator is formed by a dielectric with an electrode film on it.

In order to obtain a dielectric filter having desired characteristics, a method has been used in which some electrode portions or some dielectric portions are cut so as to be removed, and/or alternatively some adjustment screws are driven so as to insert or remove some dielectric members or some metal members, thereby effecting a desired characteristic adjustment.

If physical properties of the materials forming a dielectric filter are made constant and if sizes of various portions of the dielectric filter are maintained with extremely high precision, it will be allowed to obtain substantially constant characteristics all the time. However, since there are in fact some irregularities in these characteristics, such irregularities should be taken into account in the actual design process. For example, a method has been in practical use in which when a resonance frequency is to be determined, an initial resonance frequency is designed so that it is always slightly below a desired resonance frequency, and some dielectric portions are cut and removed until the resonance frequency becomes the desired resonance frequency.

However, because perturbations caused by the cutting or adding or the insertion or removal of a dielectric material or an electrically conductive material in certain adjustment positions for adjusting the above-mentioned characteristics, a characteristic change of an object being adjusted is not necessarily linear. For this reason, the characteristic adjustment has been carried out manually, utilizing the experience and feeling of a human worker. This however, results in a problem, namely that productivity is low and it is impossible to carry out a constantly stabilized manufacturing process.

To cope with the above problem, Japanese Patent No. 2740925 discloses an automation capable of automatically adjusting the characteristics of the above-discussed electronic parts. This disclosure requires that when a characteristic variation relationship is calculated with respect to an adjusting amount at portions for characteristic adjusting so as to calculate only an adjusting amount for obtaining a predetermined characteristic in accordance with the above relationship, it is necessary to eliminate a problem called defective adjustment, which is caused due to a fact that the curves of characteristic variations will be different from one another corresponding to adjusting amounts of various products. For this reason, it is needed to obtain actual data by trimming the number of predetermined samples and it is also required to successively renew the trimming conditions with respect to the electronic parts of the predetermined numbers of samples, thereby dealing with an irregularity problem that occurs among respective lots of electronic parts and in respective manufacturing processes.

In order to provide a dielectric filter formed by a plurality of dielectric resonators and/or a combined input/output device such as a duplexer, a multiple mode dielectric resonator has been used, in order that the filter may be made light in weight and compact in size. For example, when a cross-shaped dielectric column is used so as to make use of a double mode or a triple mode, some predetermined portions of the above dielectric column have to be cut off so as to adjust the resonance frequency of each resonator. However, with a plurality of resonance modes, it is impossible to adjust the resonance frequency of one resonator (which may be referred to as an adjustment object) completely independently of other resonators. For instance, if certain portions of the dielectric column are cut off, the resonance frequencies of several resonance modes will be undesirably changed at the same time. There is only a ratio difference, which determines which resonance mode receives the largest influence. For this reason, in a case when it is required to adjust the characteristics of a dielectric filter employing several triple mode resonators, it is no longer substantially possible to use a method in which a human operator is allowed to perform the adjustment while at the same time adjusting the characteristics of the filter with a network analyzer.

SUMMARY OF THE INVENTION

To address these problems, the present invention provides a method and an apparatus for automatically and exactly adjusting the characteristics of a dielectric filter within a reduced time period.

One embodiment of the method invention comprises: an electric parameter extracting step including measuring characteristic parameters of a dielectric filter whose characteristics are to be adjusted, and thus calculating electric parameters of a designed equivalent circuit of the filter with the use of the characteristic parameters; an adjustment function generating step including adjusting electric parameter adjusting portions of the dielectric filter, thus generating, with the use of the electric parameters, advantageously obtained by an electric parameter extracting, device and with the use of an adjusting amount, adjustment functions indicating a variation amount of the electric parameters with respect to the adjusting amount; an adjusting amount calculating step for calculating the adjusting amount, in accordance with simultaneous equations involving the adjustment functions, with the use of electric parameters obtained before the adjustment and with the use of desired electric parameters; and an adjusting step for adjusting an amount calculated in the adjusting amount calculating step, further, the electric parameter extracting step and the adjusting amount calculating step and the adjusting step are repeatedly carried out until the characteristic parameters of the dielectric filter arrive at predetermined values.

In the adjusting amount calculating step, an adjusting amount is calculated by multiplying a calculation result with a predetermined ratio, the calculation result being obtained by incorporating into the simultaneous equations involving the adjustment functions, the electric parameters obtained in the electric parameter extracting step and the desired electric parameters.

In this way, in accordance with the simultaneous equations involving adjustment functions, the characteristic parameters (S parameters) of the dielectric filter are measured, the adjusting amounts of electric parameter adjusting portions are calculated with the use of a difference between electric parameters of a designed equivalent circuit of the filter calculated from the characteristic parameters and the desired electric parameters. By repeatedly correcting the calculated adjusting amounts until the characteristic parameters of the dielectric filter arrive at predetermined values, it is possible to exactly and automatically adjust the characteristics of a dielectric filter without depending upon the experience and feelings of a human operator as in conventional methods.

A further embodiment of the invention relates to apparatus for carrying out the methods described herein.

Other aspects, features and advantages of the invention will become apparent from the following.

BRIEF DESCRIPTION OF THE DRAWINGS

FIG. 10 is a table showing a relationship between the electric parameters forming a filter having the designed equivalent circuit and the electric parameters of a resonator unit.

DESCRIPTION OF EMBODIMENTS OF THE INVENTION

A method and an apparatus for automatically adjusting the characteristics of a dielectric filter, in relation to an embodiment of the present invention, will be described in the following with reference to FIGS. 1 to 6.

Figure 1:
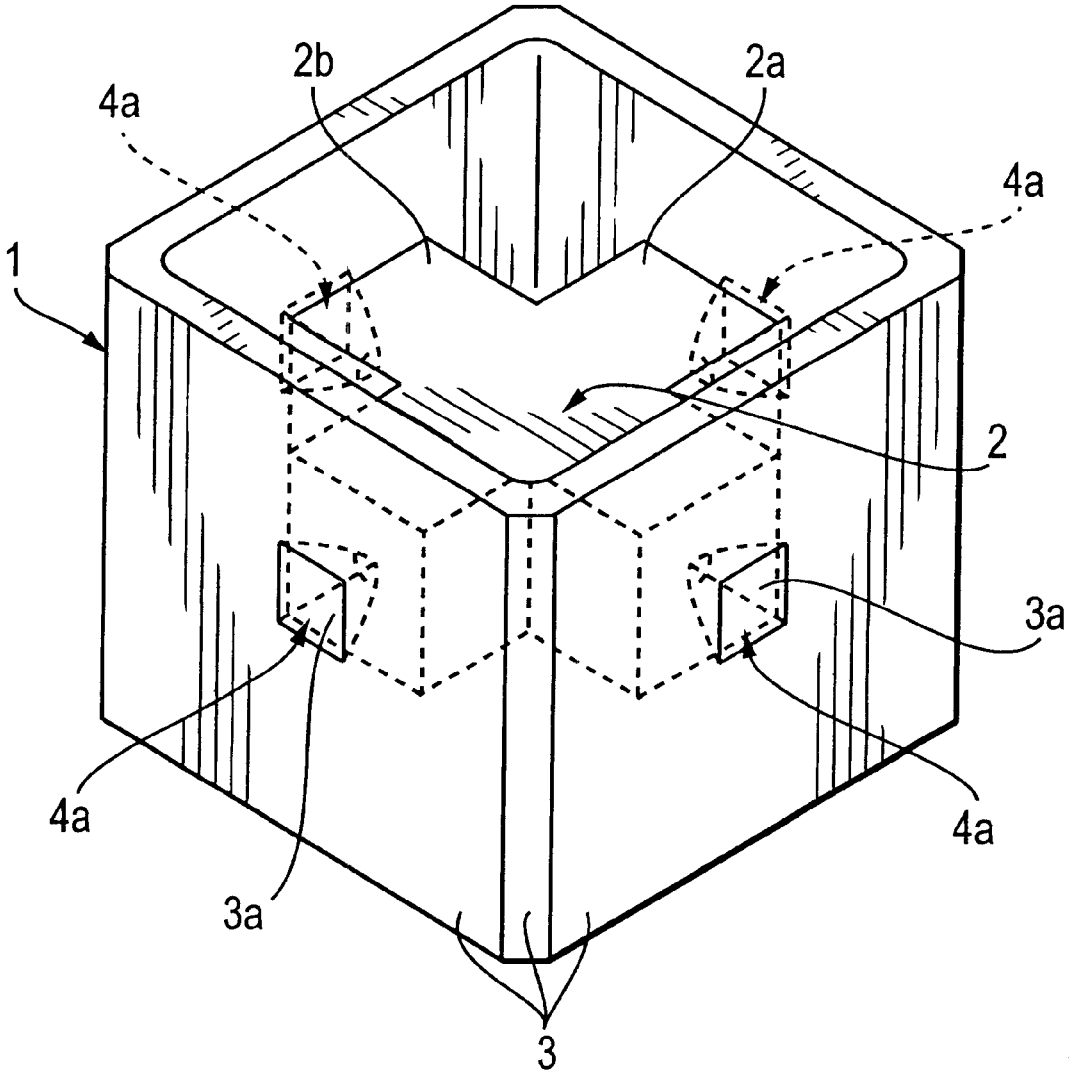
FIG. 1 is a perspective view showing a portion of a dielectric resonator.

FIG. 1 is a perspective view schematically indicating some important portions of a dielectric filter which is used as an example of a method for adjusting its characteristics. In FIG. 1, reference numeral 1 is used to represent a dielectric cavity within which there is integrally formed a composite dielectric column 2 having two dielectric columns 2*a* and 2*b* arranged in a mutually orthogonal relationship with each other. Corresponding to each end face of each of the two dielectric columns 2*a* and 2*b* and near the center of each wall of the cavity 1, a respective recess portion 4*a* is formed, extending from the outer surface of the corresponding wall inwardly into a deep position in the corresponding one of the dielectric columns 2*a* and 2*b*. An electrically conductive material 3*a* is formed on the surface of each recess portion 4*a*. Such electrically conductive material 3*a* is in continuous connection with electrically conductive material 3 formed on the outer surface of the cavity 1.

Figure 2A:
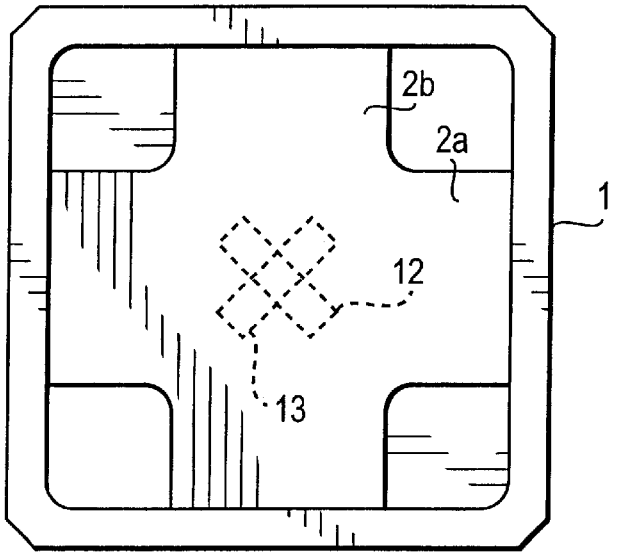
FIGS. 2A and 2B are respectively a top plan view and a cross-sectional view of a first dielectric filter.
Figure 2B:
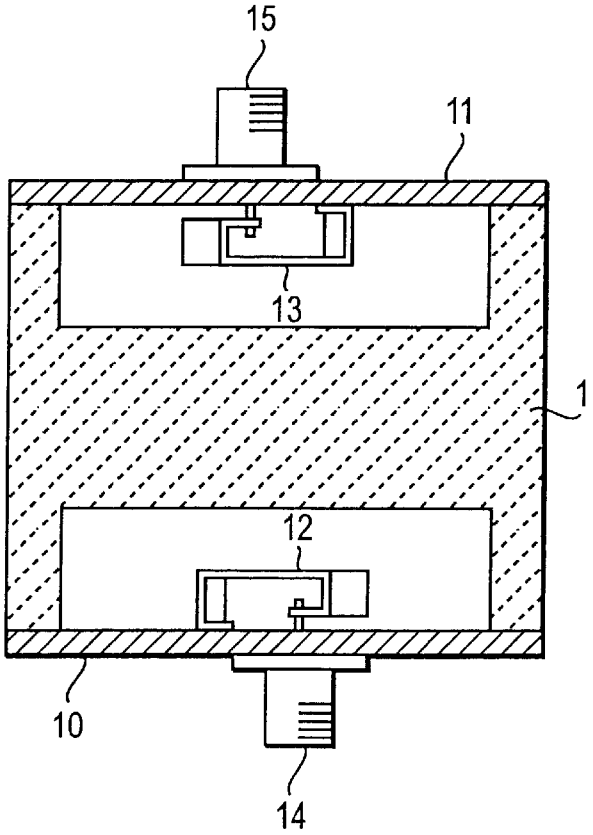

FIGS. 2A–2B illustrate an example in which a pair of outer coupling loops and corresponding coaxial connectors are attached to the above-mentioned multiple mode dielectric resonator, thereby forming a band pass filter having a 3-stage resonator. In detail, FIG. 2A is a plan view schematically indicating a condition before an electrically conductive plate is attached on to the opening of the cavity, while FIG. 2B is a longitudinal sectional view seen from the front side thereof. On the outer surfaces of electrically conductive plates 10 and 11 covering up two openings formed on the upper and lower sides of the cavity 1, there are provided two coaxial connectors 14 and 15, while on the inner surfaces of the electrically conductive plates there are attached coupling loops 12 and 13. These coupling loops 12 and 13, as shown in FIG. 2A, are each arranged in a 45-degree relationship with respect to each dielectric column 2*a*, 2*b* of the composite dielectric column 2. The coupling loop 12 is magnetically combined with $TM_{110(x+y)}$ mode which is a first resonance mode, while the coupling loop 13 is magnetically combined with $TM_{110(x-y)}$ mode which is a third resonance mode. As will be related later in the present specification, a $TM_{111}$ mode which is a second resonance mode will be generated in addition to the above first and third resonance modes, so that the first, second and third resonance modes may be combined successively, thereby obtaining a dielectric filter having the characteristics of a band pass filter consisting of a 3-stage resonator.

Figure 3:
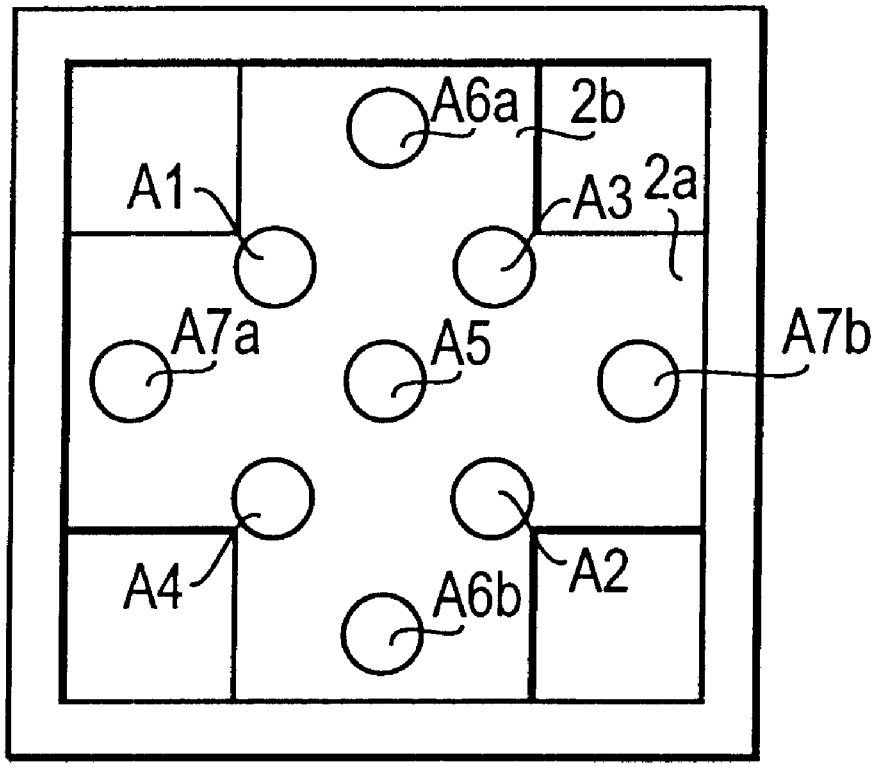
FIG. 3 is a schematic view showing an example of portions at which electric parameters are adjusted.

FIG. 3 indicates some portions of a composite dielectric column at which electric parameters of a triple mode dielectric resonator can be adjusted.

Figure 4A:
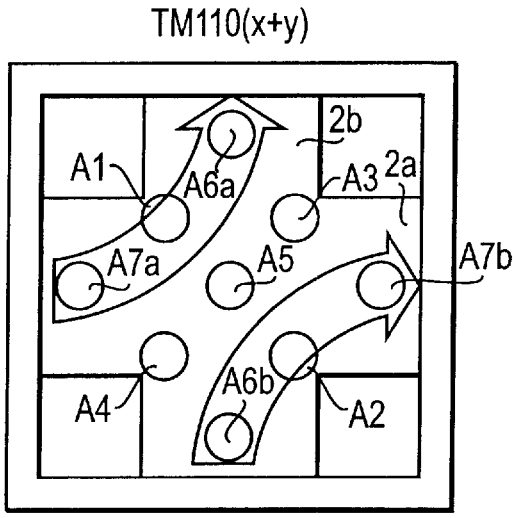
FIGS. 4A, 4B and 4C are schematic views indicating the relationships between three resonance modes and characteristic adjusting portions.
Figure 4B:
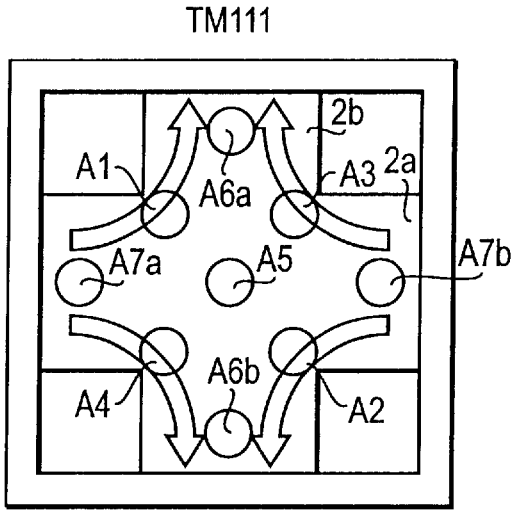
Figure 4C:
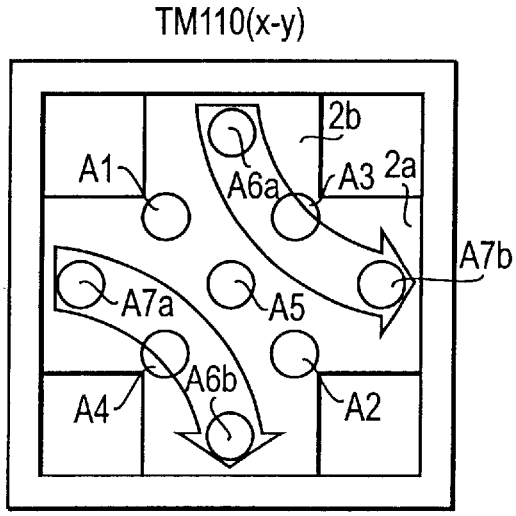

FIG. 4A indicates an electric field distribution of $TM_{110(x+y)}$ mode which is the first resonance mode, FIG. 4B indicates an electric field distribution of $TM_{111}$ mode which is the second resonance mode, FIG. 4C indicates an electric field distribution of $TM_{110(x-y)}$ mode which is the third resonance mode.

In a triple mode resonator, the electric parameters include resonance frequencies f1, f2 and f3 of the first, second and third resonance modes, a coupling coefficient K12 between the first and second resonance modes, and a coupling coefficient K23 between the second and third resonance modes, a coupling coefficient K13 between the first and third resonance modes. In order to adjust these electric parameters, it is preferable to select nine or more than nine portions for cutting as shown in FIG. 3. However, in practical use, seven places are sufficient.

For example, if a portion A1 is cut, f1 and f2 will rise and k12 will be increased. By cutting the portion A1, if an portion A2 is also cut under a condition in which k12 is occurring (a condition in which the above first and second resonance modes are combined together), f1 and f2 will rise and k23 will be decreased.

If portion A3 is cut, mainly f2 and f3 will rise and k23 will be increased. By cutting the portion A3, if a portion A4 is also cut under a condition in which k23 is occurring (a condition in which the above second and third resonance modes are combined together), f2 and f3 will rise and k23 will be decreased.

If a portion A5 is cut, mainly f1 and f3 will rise. Further, if portion A6*a* or A6*b* are cut, mainly f1 and f3 will rise and k13 will be increased. Under a condition in which k13 is occurring, if portion A7*a* or A7*b* are cut, f1 and f3 will rise and k13 will be decreased.

Figure 12:
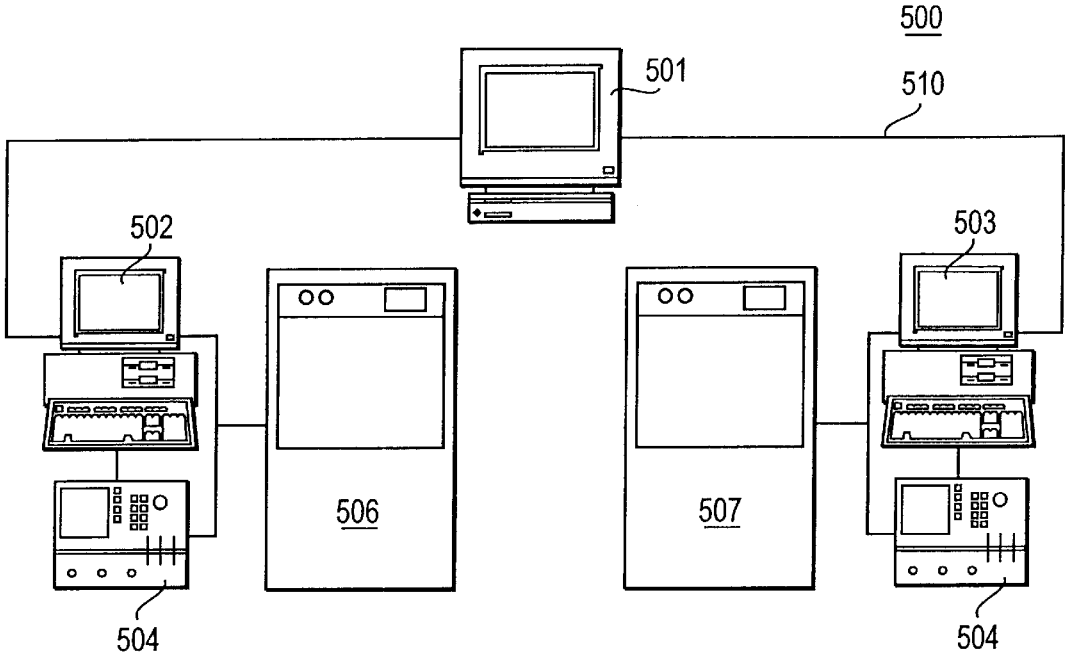
FIG. 12 is a schematic plan view of the system for automatically adjusting the characteristic of dielectric filters according to the present invention.

Hereinafter, the adjusting method of the present invention will be described. The method is performed by the system 500 shown in FIG. 12 for example.

Adjusting machines 506 and 507 are controlled by the local computers 502 and 503 respectively. Each adjusting machine includes a conveyer for bringing a filter to be adjusted into a predetermined portion wherein the filter is cut at the above-described adjusting portions, and a drill for removing the dielectric from the filter. The movement of the drill is controlled by the local computer to remove a predetermined amount of dielectric. After adjusting one filter, the conveyer next moves another filter to the predetermined portion for cutting the dielectric. The adjusting machines are connected to network analyzers 504 and 505 for measuring the electrical characteristics of the filter to be adjusted. The analyzers are also controlled by the local computers. The local computers 502 and 503 are further connected to a server computer 501 via local area network 510 for example. Measured data may be forwarded from the local computer to the server computer and be processed in the server. In accordance with the result of the data processing, the local computers control the adjusting machines to further adjust the dielectric filters in the machines.

First, the characteristic of a single dielectric filter is measured. The electric parameters of the filter are decomposed into electric parameters for each resonator unit, so that an amount that each adjustment portion is cut and an amount that each electric parameter is changed may be functionalized by use of a least square method. Such a function may be approximated by use of an exponential function such as a second order function and a third order function. Among the above nine adjustment portions shown in FIG. 3, if any one of A6*a* and A6*b*, and any one of A7*a* and A7*b*, is cut, and if the cutting amounts of the adjustment portions which are seven in all are represented by Zn (n=1, 2, 3, 4, 5, 6, 7), the following relational equations can thus exist.

About adjustment portion A1:

$$f1=f1ini(1+\psi 11(Z1))$$

$$f2=f2ini(1+\psi 12(Z1))$$

$$f3=f3ini(1+\psi 13(Z1))$$

$$k12=k12ini+\psi 14(Z1)$$

$$k23=k23ini+\psi 15(Z1)$$

$$k13=k13ini+\psi 16(Z1)$$

About adjustment portion A2:

$$f1=f1ini(1+\psi 21(Z2))$$

$$f2=f2ini(1+\psi 22(Z2))$$

$$f3=f3ini(1+\psi 23(Z2))$$

$$k12=k12ini+\psi 24(Z2)$$

$$k23=k23ini+\psi 25(Z2)$$

$$k13=k13ini+\psi 26(Z2)$$

About adjustment portion A3:

$$f1=f1ini(1+\psi 31(Z3))$$

$$f2=f2ini(1+\psi 32(Z3))$$

$$f3=f3ini(1+\psi 33(Z3))$$

$$k12=k12ini+\psi 34(Z3)$$

$$k23=k23ini+\psi 35(Z3)$$

$$k13=k13ini+\psi 36(Z3)$$

. . .

About adjustment portion A7:

$$f1=f1ini(1+\psi 71(Z7))$$

$$f2=f2ini(1+\psi 72(Z7))$$

$$f3=f3ini(1+\psi 73(Z7))$$

$$k12=k12ini+\psi 74(Z7)$$

$$k23=k23ini+\psi 75(Z7)$$

$$k13=k13ini+\psi 76(Z7) \quad \text{[Equation 1]}$$

Here, f1ini, f2ini, f3ini, k12ini, k23ini, k13ini are respectively initial values. Further, ψmn (n=1, 2, 3, 4, 5, 6, 7, m=1, 2, 3, 4, 5, 6) is a function of an amount that a parameter varies with respect to a cutting amount, appearing as an exponential function such as a second order function or a third order function each passing through an origin 0.

It is preferable to providing nine adjusting portions to adjust the three frequencies F1, F2 and F3, and to also adjust the three coupling coefficients k12, k23 and k31. Three of the nine portions are for increasing the three frequencies. Another three portions are for increasing the three coefficients. The remaining three portions are for decreasing the three coefficients. Adjusting portions are not needed for decreasing the three frequencies because it is not possible to lower the frequencies by cutting the dielectric. On the other hand, it is not possible to adjust only one of the above-parameters independently by cutting an adjusting portion. Adjustment in one portion for mainly adjusting a parameter more or less affects another parameter. This means that the above-mentioned six parameters can be fully adjusted by using less than nine portions.

The above adjustment functions ψ11, ψ12, ψ13, . . . ψ21, ψ22, ψ23, . . . ψ74, ψ75, ψ76 may be obtained while the adjustment portions of the dielectric filter are being actually cut, thus may be obtained as variation amounts of the parameters with respect to the cutting amounts. The procedure for such a process is shown as a flow chart in FIG. 6. First, various cutting amounts Z1 to Z7 of all the above portions are initialized. Then, S parameters are measured, thereby calculating and thus obtaining the electric parameters f1, f2, f3, k12, k23, k13 for realizing these S parameters, by virtue of a fitting calculation with respect to the designing of equivalent circuits. Then, an initial value 1 is assigned to m, which is an ordinal number of an adjustment portion, thus setting Z1 at a cutting amount for one predetermined step. Here, a cutting amount for one step is a value which may be obtained by dividing, by a predetermined maximum number of steps, a maximum allowable cutting amount predetermined with respect to that cutting portion. For example, if the maximum cutting amount is set to be 5 mm and the maximum number of steps is set to be 10 steps, a cutting amount for one step will be 0.5 mm.

A calculation is performed to obtain the variation amounts (variation coefficients) of electric parameters f1, f2, f3, k12, k23, k13 after the adjustment portion A1 of a sample has been cut by a cutting amount for one step. Next, the adjustment portion A2 is cut by a cutting amount for one step, so as to obtain the variation amounts of the above six electric parameters. Then, the adjustment portion A3 is cut by a cutting amount for one step, so as to obtain the above six parameters. From such a step onwards, in a similar manner, each of the seven adjustment portions is treated so as to obtain a variation amount for each electric parameter after the adjustment portion has been cut by a cutting amount for one step.

Subsequently, the adjustment portion A1 is cut again by a cutting amount (0.5 mm) for one step (by virtue of this, A1 will be changed from its initial state to another state in which 1.0 mm has been cut), thereby obtaining variation amounts of the above six electric parameters at this time. After that, the adjustment portion A2 is cut again by a cutting amount for one step, thereby obtaining variation amounts of the above six electric parameters at this time. From such a step onwards, in a similar manner, each of the seven adjustment portions is treated so as to obtain a variation amount of each electric parameter while at the same time cutting the adjustment portion by a cutting amount for one step.

The above treatments are conducted successively and repeatedly until a cutting amount of each adjustment portion arrives at a predetermined maximum value, thereby obtaining a variation of each electric parameter with respect to a cutting amount at each adjustment portion. Finally, for each adjustment portion, a curve showing the changes of each electric parameter with respect to a cutting amount may be obtained as an approximate curve by virtue of the Least Square Method. These curves are corresponding to the above functions ψ11, ψ12, ψ13, . . . ψ21, ψ22, ψ23, . . . ψ75, ψ76.

Figure 5:
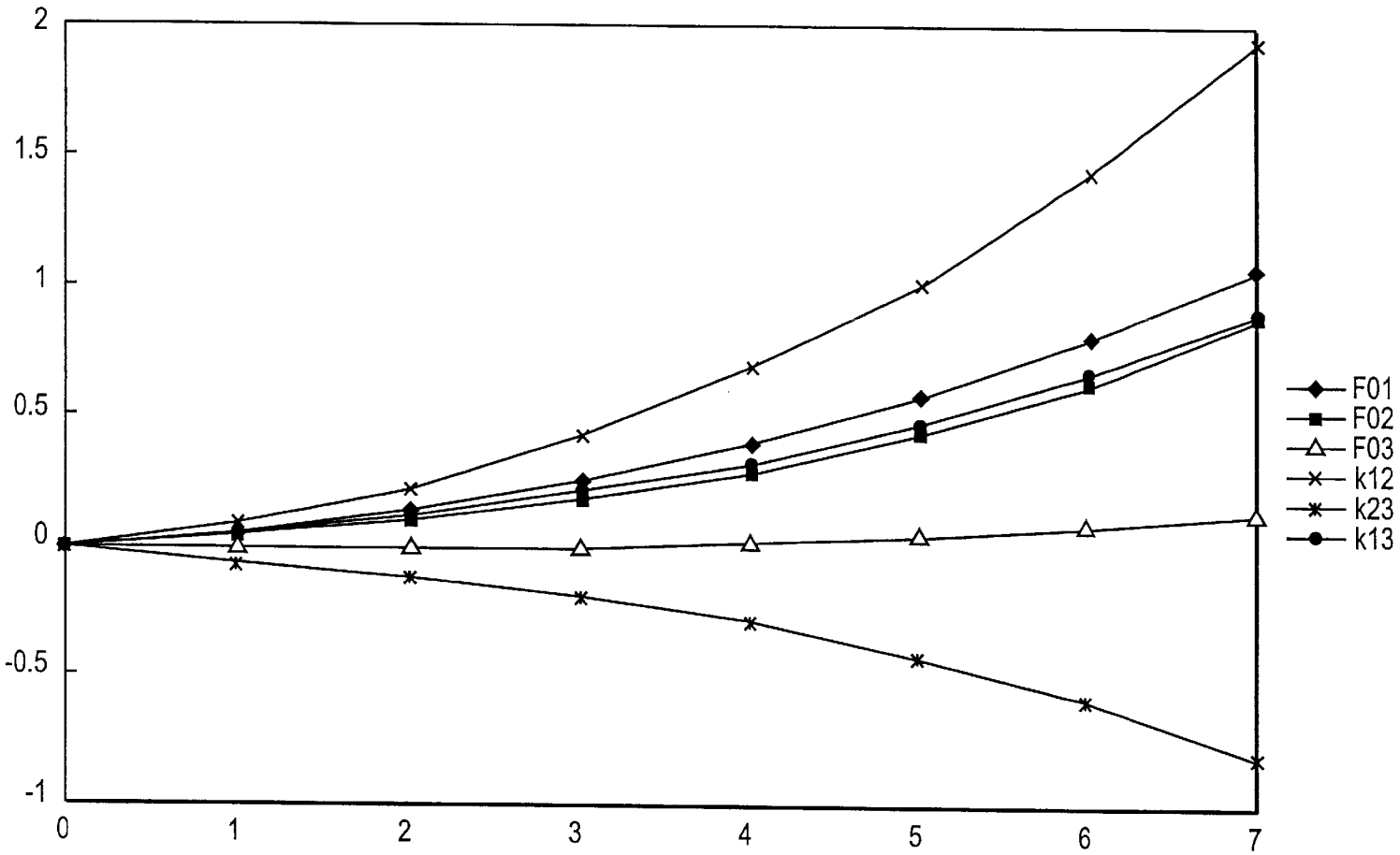
FIG. 5 is a graph indicating a variation of the electric parameters with respect to an amount of cutting at one portion for adjusting the electric parameters.
Figure 6:
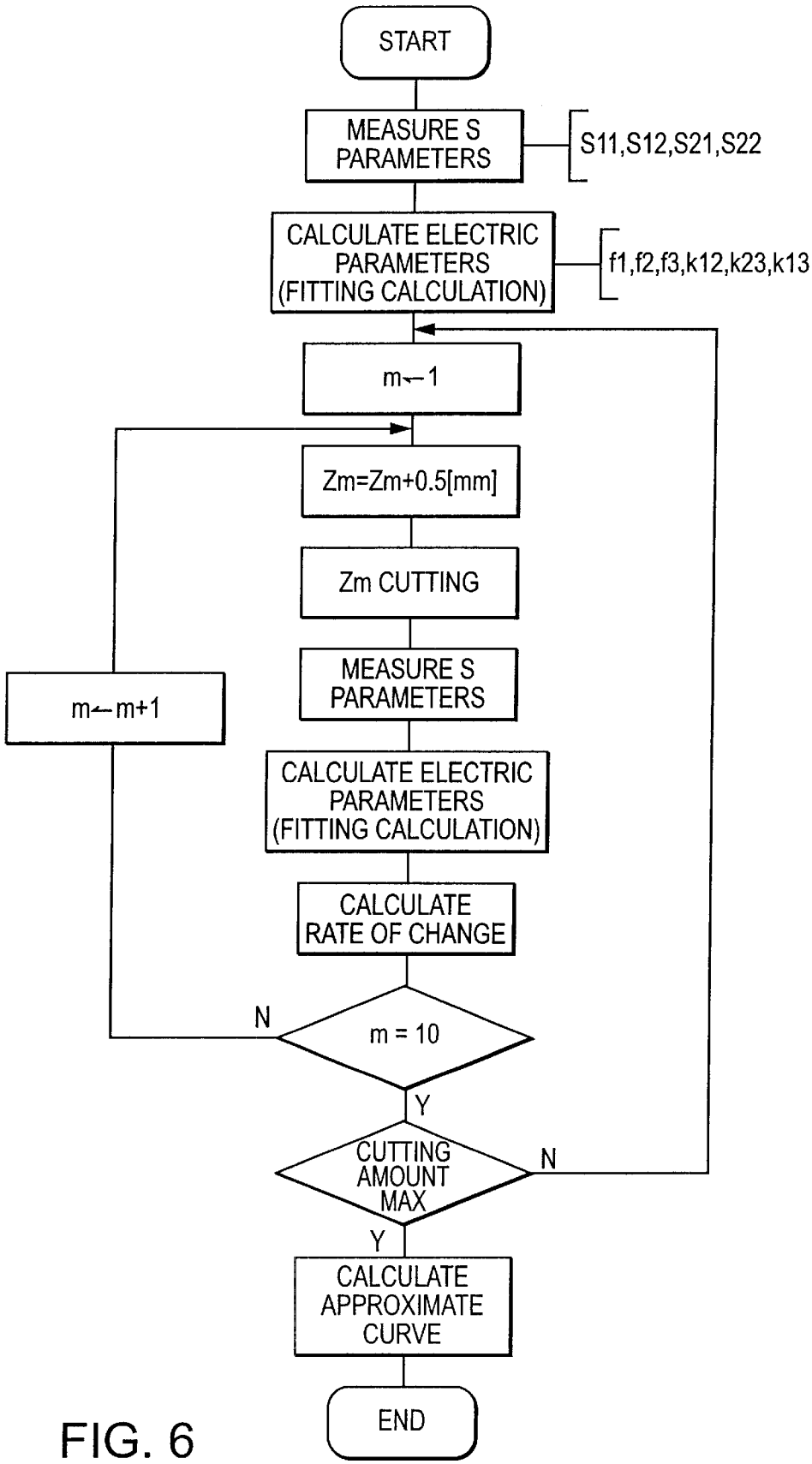
FIG. 6 is a flow chart indicating a first example of a characteristic adjusting procedure.

FIG. 5 is used to show calculation results indicating variations of various electric parameters at the adjustment portion A1 under a condition where an allowable maximum cutting amount 7 mm has been cut in seven steps. The horizontal axis is used to represent a cutting amount and the vertical axis is used to represent a rate of change for each electric parameter. F01, F02, F03 are used to indicate the changes of the above f1, f2, f3 in the form of a change rate. Further, k12, k23 and k13 are each indicated in the form of an absolute value. In an example shown in this figure, the adjustment functions may be indicated by the following second order functions.

$$\psi 11(Z1)=(1.6721\times 10^{-2})Z1^2+(4.0662\times 10^{-2})Z1$$

$$\psi 12(Z1)=(1.5943\times 10^{-2})Z1^2+(1.6339\times 10^{-2})Z1$$

$$\psi 13(Z1)=(5.0085\times 10^{-2})Z1^2+(1.3070\times 10^{-2})Z1$$

$$\psi 14(Z1)=(3.2535\times 10^{-2})Z1^2+(5.0863\times 10^{-2})Z1$$

$$\psi 15(Z1)=(-1.2683\times 10^{-2})Z1^2+(2.6757\times 10^{-2})Z1$$

$$\psi 16(Z1)=(1.4478\times 10^{-2})Z1^2+(3.0814\times 10^{-2})Z1$$

In this example, by cutting the adjustment portion A1, f1 and f2 will be rising at a higher rate than f3. Further, k12 will be changed at a higher rate than k23 and k13.

In accordance with the above equation 1, since the electric parameters f1ini, f2ini, f3ini, k12ini, k23ini, k13ini may be calculated with the use of measurement results, if there are provided desired electric parameters f1, f2, f3, k12, k23, k13, it is possible to obtain cutting amounts Z1, Z2, Z3, Z4, Z5, Z6, Z7 which can satisfy the above parameters.

However, even if several dielectric filters have been manufactured and assembled in the same manner, the characteristics of these dielectric filters can still be different more or less from one another, since commonly differences exist in the size of various portions and the assembling precision may not be so satisfactory. For this reason, although a cutting operation may be performed in accordance with a cutting amount obtained by virtue of calculation, electric parameters may not vary in accordance with the above functions. Accordingly, it is necessary to perform a correction of the above functions in accordance with actual matters. Therefore, if a cutting is completed for about 50% of a necessary cutting amount calculated by the above calculation and the characteristic adjustment is performed in several stages, and if the initial values of the parameters are corrected, the variation of the electric parameters with respect to cutting amount may be properly dealt with in accordance with the predetermined functions. In more detail, the characteristics may be adjusted in the following manner.

First, the electric parameters of a dielectric filter under a condition where no cutting has been conducted at all, are used as initial values f1ini, f2ini, f3ini, k12ini, k23ini, k13ini. Further, the desired values of the electric parameters in a resonator unit, which may be used to obtain desired filter characteristics, are defined as f1trg, f2trg, f3trg, k12trg, k23trg, k13trg.

During an initial cutting treatment, since a correction amount with respect to an initial amount is not clear, the following simultaneous equations are solved, so as to calculate the cutting amounts Z1, Z2, Z3, Z4, Z5, Z6, Z7.

$$f1trg=f1ini(1+\psi 11(Z1)+\psi 21(Z2)+\psi 31(Z3)+\psi 41(Z4)+\psi 51(Z5)+\psi 61(Z6)+\psi 71(Z27))$$

$$f2trg=f2ini(1+\psi 12(Z1)+\psi 22(Z2)+\psi 32(Z3)+\psi 42(Z4)+\psi 52(Z5)+\psi 62(Z6)+\psi 72(Z7))$$

$$f3trg=f3ini(1+\psi 13(Z1)+\psi 23(Z2)+\psi 33(Z3)+\psi 43(Z4)+\psi 53(Z5)+\psi 63(Z6)+\psi 73(Z7))$$

$$k12trg=k12ini+\psi 14(z1)+\psi 24(Z2)+\psi 34(Z3)+\psi 44(Z4)+\psi 54(Z5)+\psi 64(Z6)+\psi 74(Z7)$$

$$k23trg=k23ini+\psi 15(Z1)+\psi 25(Z2)+\psi 35(Z3)+\psi 44(Z4)+\psi 55(Z5)+\psi 65(Z6)+\psi 75(Z7)$$

$$k13trg=k13ini+\psi 16(Z1)+\psi 26(Z2)+\psi 36(Z3)+\psi 46(Z4)+\psi 56(Z5)+\psi 66(Z6)+\psi 76(Z7) \quad \text{[Equation 2]}$$

However, since there are seven unknown variables and there are six equations, it is impossible to obtain these unknown variables in a simple manner. But, since a possible cutting amount is not boundless, for example, possible cutting amounts for Z1 to Z7 are all in a range of 0 mm to 6.0 mm, i.e., each having a limited range, it is required that these conditions and Zn to Z7 are obtained at the same time. Then, actual cutting amounts Z1' to Z7' may be calculated as follows:

$$Z1'=Z1\times 0.5$$

$$Z2'=Z2\times 0.5$$

$$Z3'=Z3\times 0.5$$

$$Z4'=Z4\times 0.5$$

$$Z5'=Z5\times 0.5$$

$$Z6'=Z6\times 0.5$$

$$Z7'=Z7\times 0.5$$

The above coefficient 0.5 is called a cutting amount achievement ratio. A larger cutting amount achievement ratio (the closer it gets to 1 the better) can produce a higher speed for the adjustment. However, with a larger ratio, a run-in precision with respect to a desired value of an electric parameter will decrease. In contrast, if the cutting amount achievement ratio is made small, a speed for the adjustment will become slow, but it will be possible to improve the run-in precision with respect to a desired value of an electric parameter.

In the (nth) cutting treatments conducted from the second time onwards, after a previous cutting treatment (the (n−1) th) is finished, the electric parameters obtained from the characteristic parameters (S parameters) of a dielectric filter are defined to be f1new, f2new, f3new, k12new, k23new, k13new, and actually cut amounts are defined to be Z1', Z2', Z3', Z4', Z5', Z6', Z7', thereby calculating f1rev, f2rev, f3rev, k12rev, k23rev, k13rev, with the use of the following equations.

$$f1rev=f1new/(1+\psi11(Z1')+\psi21(Z2')+\psi31(Z3')+\psi41(Z4')+\psi51(Z5')+\psi61(Z6')+\psi71(Z7'))$$

$$f2rev=f2new/(1+\psi12(Z1')+\psi22(Z2')+\psi32(Z3')+\psi42(Z4')+\psi52(Z5')+\psi62(Z6')+\psi72(Z7'))$$

$$f1rev-f3new/(1+\psi13(Z1')+\psi23(Z2')+\psi33(Z3')+\psi43(Z4')+\psi53(Z5')+\psi63(Z6')+73(Z7'))$$

$$k12rev=f12new-(\psi14(Z1'')+\psi24(Z2')+\psi34(Z3')+\psi44(Z4')+\psi54(Z5')+\psi64(Z6')+\psi74(Z7'))$$

$$K23rev=K23new-(\psi15(Z1')+\psi25(Z2')+\psi35(Z3')+\psi45(Z4')+\psi55(Z5')+\psi65(Z6')+\psi75(Z7'))$$

$$K13rev=k13new-(\psi16(Z1')+\psi26(Z2')+\psi36(Z3'')+\psi46(Z4')+\psi56(Z5')+\psi66(Z6')+\psi76(Z7')) \quad \text{[Equation 3]}$$

The above [Equation 3] is an inverse calculation of the above [Equation 2], and may be used to calculate initial values which can be used to adjust a relationship between the present electric parameters and adjustment functions. Namely, in the above equations, $$f1ini=f1rev$$

$$f2ini=f2rev$$

$$f3ini=f3rev$$

$$k12ini=k12rev$$

$$K23ini=k23rev$$

$$k13ini=k13rev$$

Initial values may be corrected in the above manner. Then, the simultaneous equation of [Equation 2] is solved, so as to obtain new cutting amounts Z1, Z2, Z3, Z4, Z5, Z6, Z7. However, since these cutting amounts are absolute amounts, and since the cuttings of Z1' to Z7' are carried out at various adjustment portions, in addition, since the cutting amount achievement ratios are set at 0.5, the actual cutting amounts at this time are as follows with respect to the adjustment portions A1 to A7.

$$(Z1-Z1')\times0.5$$

$$(Z2-Z2')\times0.5$$

$$(Z3-Z3')\times0.5$$

$$(Z4-Z4')\times0.5$$

$$(Z5-Z5')\times0.5$$

$$(Z6-Z6')\times0.5$$

$$(Z7-Z7')\times0.5$$

Here, one embodiment is indicated below by taking f1 as an example. For example, in a case where f1tag=890 [MHZ], f1ini=880 [MHZ], and if Z1=10 [mm] as a result of solving [Equation 2], and if a cutting amount achievement ratio is set to be 0.5, then 10×0.5=5 [mm], an actual cutting amount will be 5 [mm]. After that, if a measurement is again performed and it is found that f1=886 [MHZ], f1new in [Equation 3] may be replaced by 886 [MHZ], while Z1' to Z7' may be replaced by an actually cut amount (Z1'=5 [mm]), thereby calculating f1rev, f2rev, f3rev, k12rev, k23rev, k13rev. Here, if f1rev=879.5 [MHZ], this may be used to replace f1ini in [Equation 2]. Then, f1tag=890 [MHZ] is incorporated into [Equation 2] so as to obtain Z1 to Z7. If Z1=11 [mm], since a cutting amount at a first time will be 5 [mm], a cutting amount at a second time will be 3 [mm] because of 11−5=6, and 6×0.5=3 [mm]. The treatments from this step onwards are conducted in similar manner.

Figure 7:
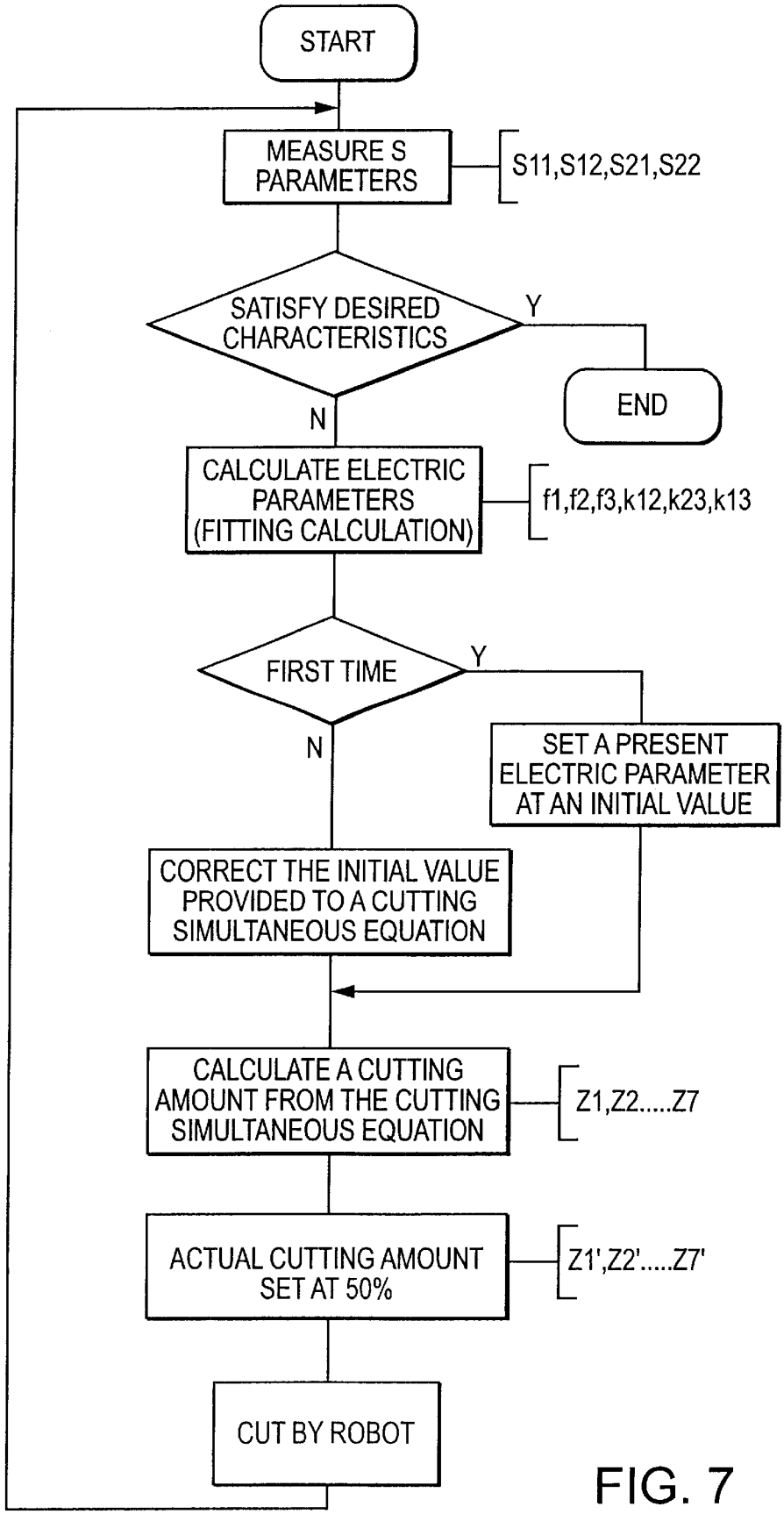
FIG. 7 is a flow chart indicating a second example of a characteristic adjusting procedure.

Next, an entire procedure for the characteristic adjustment method is indicated by a flow chart shown in FIG. 7. First, a network analyzer is used to measure S parameters (S11, S12, S21, S22) of a dielectric filter whose characteristics are to be adjusted. If a value thus measured is not within a desired range (under a condition where the cutting has not been conducted, such a measured value is surely within the desired range), the electric parameters (which are the electric parameters for realizing the characteristics indicating the above S parameters) corresponding to the above S parameters, may be obtained by virtue of a fitting calculation with respect to the designed equivalent circuit for the filter. If it is an initial cutting, the present electric parameters f1, f2, f3, k12, k23, k13 thus calculated, may be used as initial values f1ini, f2ini, f3ini, k12ini, k23ini, k13ini in the simultaneous equations shown in [Equation 2]. The desired parameters f1trg, f2trg, f3trg, k12trg, k23trg, k13trg of [Equation 2] are obtained by a fitting calculation with respect to the designed equivalent circuit of the filter, in order that these desired parameters may be used as electric parameters for realizing desired S parameters. Further, the adjustment functions ψ11, ψ21, ψ31, ψ41, . . . ψ76 are calculated in advance by virtue of the cutting of the samples. These known quantities are incorporated into [Equation 2] so as to calculate the cutting amounts Z1, Z2, Z3, Z4, Z5, Z6, Z7. Further, 50% of each of the cutting amounts are set to be actual cutting amounts Z1', Z2', Z3', Z4', Z5', Z6', Z7'', and are then cut by a robot.

After that, S parameters are measured so as to determine whether they are within the desired ranges. If the measured parameters are not within the desired ranges, electric parameters can be calculated from the present S parameters. Next, the calculated electric parameters f1, f2, f3, k12, k23 and k13 are used as electric parameters f1new, f2new, f3new, k12new, k23new and k13new in [Equation 3], followed by incorporating the actual cutting amounts Z1', Z2', Z3', Z4', Z5', Z6', Z7', thereby solving [Equation 3] and thus calculating electric parameters f1rev, f2rev, f3rev, k12rev, k23rev, k13rev. Further, these parameters are used as f1ini, f2ini, f3ini, k12ini, k23ini, k13ini, so as to correct initial values. After that, the next cutting amounts Z1, Z2, Z3, Z4, Z5, Z6, Z7 are calculated from the above simultaneous equations of [Equation 2], thereby carrying out a predetermined cutting treatment by means of a robot, with an actual cutting amount being 50% of an amount which should be newly cut. By repeating the above treatment again and again, S parameters will be made gradually close to the desired ranges, thus completing the above treatment once the parameters enter the desired ranges.

In the foregoing example, a cutting amount achievement ratio of less than 100% has been used. Nevertheless, when differences with respect to the desired values of S parameters have become smaller than predetermined values, and further, when differences with respect to the desired values of electric parameters have become smaller than predetermined values, it is possible to make the above cutting amount achievement ratio 100% so as to complete the adjustment at one stroke. Further, it is also possible that with many repeated cutting treatments, the above cutting amount achievement ratio can be made larger, thus shortening the total time necessary for the above adjustment, without having any influence on the run-in precision with respect to the desired values.

In the embodiment shown in the above, although an example has been given which is a dielectric filter consisting of a 3-stage resonator employing only one triple mode dielectric resonator, such an embodiment is also suitable for use in a case where a dielectric filter is constituted by using a single mode dielectric resonator. Further, it is also suitable for use in a case where a single dielectric filter is formed by using a plurality of dielectric resonators.

Next, FIGS. 8 to 11 are used to indicate another example where a dielectric filter having a band pass characteristic has been constituted, using two triple mode dielectric resonators and thus forming a 6-stage resonator.

Figure 8A:
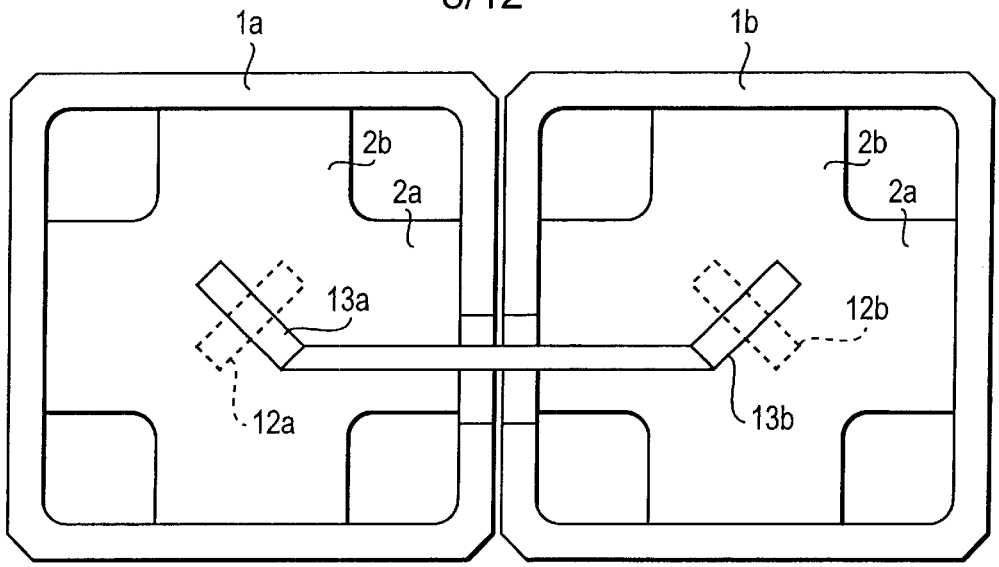
FIGS. 8A and 8B are respectively a top plan view and a cross-sectional view of a second dielectric filter.
Figure 8B:
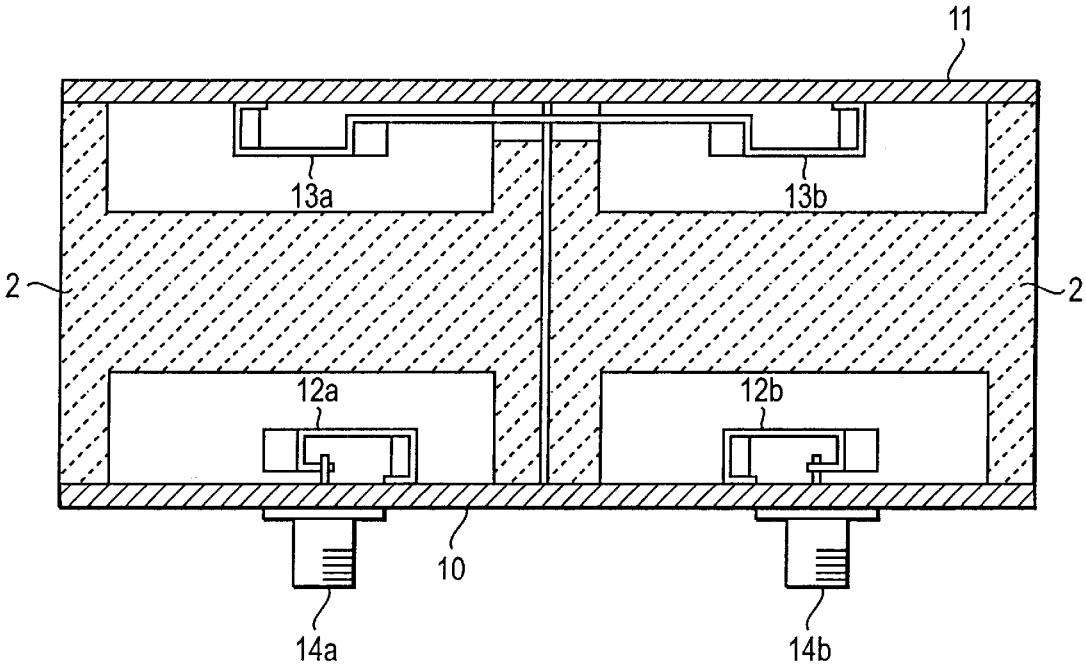

FIGS. 8A–8B provide views showing the structure of a dielectric filter. FIG. 8A is a plan view showing the filter but not including an electrically conductive plate disposed on the upper opening of the cavity. FIG. 8B is a longitudinal sectional view when seen from the front side thereof. On the two openings located on the upper and lower sides of cavities 1*a* and 1*b*, there are provided two electrically conductive plates 10 and 11. Two coaxial connectors 14*a* and 14*b* are attached to the outer surface of the electrically conductive plate 10, while two combination loops 12*a* and 12*b* are attached to the inner surface of plate. These combination loops 12*a* and 12*b*, as shown in FIG. 8A, are each arranged in a 45-degree relationship with respect to each dielectric column of the corresponding composite dielectric resonator 2. Combination loop 12*a* is magnetically coupled with $TM_{110(x+y)}$ mode, while combination loop 13*a* is magnetically coupled with $TM_{110(x-y)}$ mode. Similarly, combination loop 12*b* is magnetically coupled with $TM_{110(x+y)}$ mode, while combination loop 13*b* is magnetically coupled with $TM_{110(x-y)}$ mode. As in the embodiment described above, a $TM_{111}$ mode is also generated, so as to be successively coupled with a triple resonance mode. In this way, the combination loop 12*a*→$TM_{110(x+y)}$ mode→$TM_{111}$ mode→$TM_{110(x-y)}$ mode→combination loops 13*a*, 13*b*→$TM_{110(x-y)}$ mode→$TM_{111}$ mode→$TM_{110(x+y)}$ mode→combination loop 12*b*, may be combined successively in the above order, thereby forming a dielectric filter which has a band pass filter characteristic consisting of a 6-stage resonator.

Figure 9:
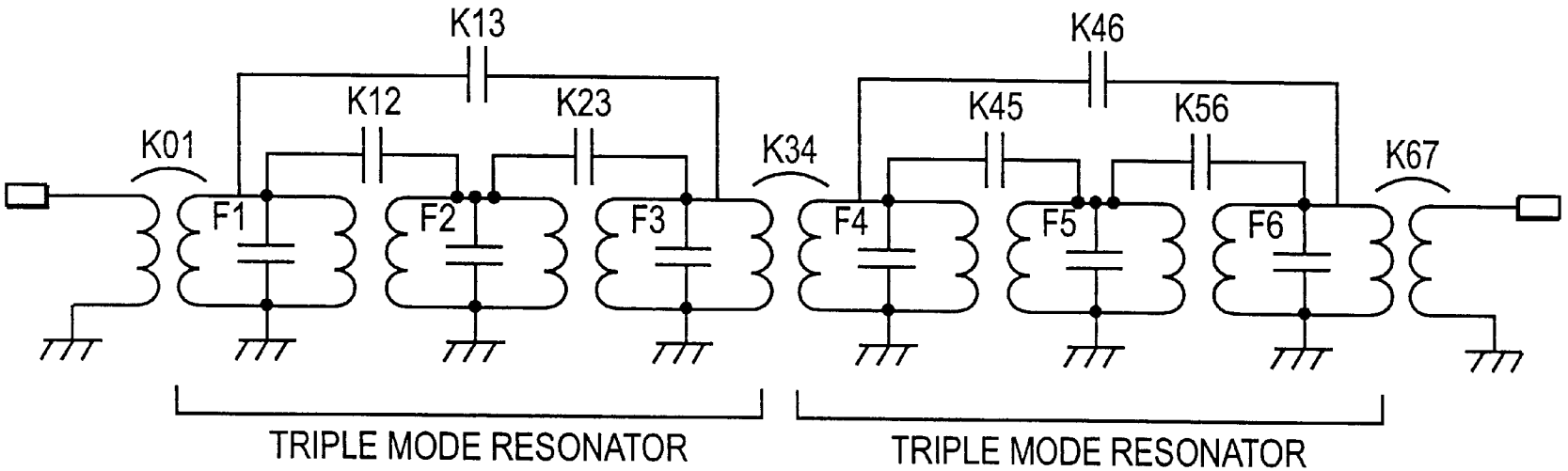
FIG. 9 shows an equivalent circuit of the second dielectric filter.

An equivalent circuit designed for the above filter is shown in FIG. 9. Further, relationships between the electric parameters and the electric parameters of one resonator unit are shown in FIG. 10. As shown in FIG. 10, the designed parameters are electric parameters of an equivalent circuit designed for a filter consisting of a 6-stage resonator. Among the above designed parameters, K12, K23, K34, K45, K56 are main coupling coefficients, while K13 and K46 are polarization and coupling coefficients for generating attenuation poles. Further, among the above parameters, the resonator unit electric parameters f1, f2, f3, k12, k23, k13 are those to be adjusted. Among the designed parameters, K01, K34, K67, K03, K47, K07, Q1 to Q6, are fixed parameters, so that they are not to be adjusted. Note that in FIG. 9, K03, K47, and K07 are omitted.

Figure 11:
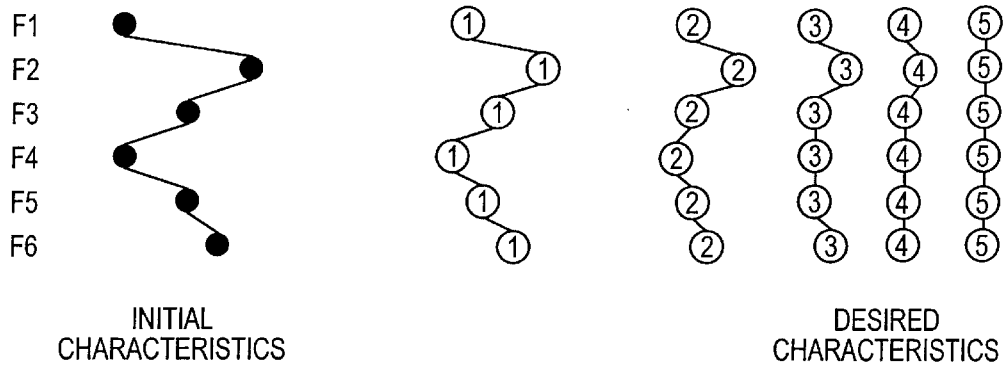
FIG. 11 is a schematic view illustrating the process by which the resonance frequency of a dielectric filter, consisting of a 6-stage resonator, converges into desired values of characteristic adjustment.

Similar to the case described above concerning a dielectric filter employing only one triple mode dielectric resonator, if the above characteristic adjustment is repeatedly carried out, the above designed parameters will get close to the desired values, thereby enabling the S parameters to be within the desired ranges. The images indicating the variations of the designed parameters F1 to F6 with the adjustment of the characteristics at this moment, are shown in FIG. 11. In this way, the resonance frequencies of each resonator as initial characteristics before cutting treatment are usually different from one another, but will be converged gradually into predetermined values step by step through the above process.

The present embodiment has taken an example of the adjustment of the characteristics of a dielectric filter formed by using a TM mode dielectric resonator employing dielectric columns. However, in a case of a filter formed by using a TEM mode dielectric resonator with electrodes formed on a dielectric block or dielectric plate, it is also possible to perform the characteristic adjustment by partially cutting off the electrodes or the dielectric portions. Further, with the TE mode dielectric resonator, it is allowed to perform the characteristic adjustment by cutting the dielectric portions.

Further, since the characteristic adjustment is effected basically by causing some kind of perturbation to the resonating system, it is also possible that said adjustment may be effected by inserting or removing a dielectric material or an electrically conductive material into or from the resonating space. Moreover, in a case where a combined adjustment is performed through a combination between the resonator and a combination means such as a combination loop, it is allowed that such an adjustment may be carried out only by adjusting the direction and deformation amount of the combination loop. In the above cases, a characteristic adjusting robot may be used to perform the above characteristics, for example by controlling an amount of insertion or removal of the dielectric material or electrically conductive material.

With the use of the present invention, in accordance with the simultaneous equations involving adjustment functions, the characteristic parameters (S parameters) of the dielectric filter are measured, the adjusting amounts of the electric parameter adjusting portions are calculated with the use of electric parameters of a designed equivalent circuit of the filter calculated from the characteristic parameters and with the use of desired electric parameters. The desired filter characteristics can be obtained simply by repeatedly correcting the calculated adjusting amount until the characteristic parameters of the dielectric filter arrive at predetermined values. For this reason, it is possible to exactly and automatically adjust the characteristics of a dielectric filter without depending upon an operator's experience and feelings as in a conventional manual process.

Although the present invention has been described in relation to particular embodiments thereof, many other variations and modifications and other uses will become apparent to those skilled in the art. Therefore, the present invention is not limited by the specific disclosures herein.

What is claimed is:

1. An apparatus for automatically adjusting the characteristics of a dielectric filter having at least one resonator unit, said apparatus comprising:

an electric parameter extracting means for extracting a plurality of electric parameters for said at least one resonator unit by measuring characteristic parameters of a dielectric filter whose characteristics are to be adjusted, and transforming the characteristic parameters into said electric parameters for said at least one resonator unit by a fitting calculation with respect to a designed equivalent circuit of the filter;

an adjustment function generating means for adjusting each of a plurality of electric parameter adjusting portions of said at least one resonator unit of said dielectric filter, thus generating, with the use of the electric parameters obtained by said electric parameter extracting means and with the use of an adjusting amount, adjustment functions indicating a variation amount of the electric parameters with respect to the adjusting amount;

an adjusting amount calculating means for calculating said adjusting amount, in accordance with simultaneous equations involving the adjustment function, with the use of electric parameters obtained before the adjustment and with the use of desired electric parameters; and an adjusting means for adjusting an amount calculated by the adjusting amount calculating means, a control means for repeatedly conducting a treatment of said plurality of electric parameter adjusting portions of said at least one resonator unit using the electric parameter extracting means, the adjusting amount calculating means, and the adjusting means, until the characteristic parameters of the dielectric filter arrive at predetermined values.

2. An apparatus for automatically adjusting the characteristics of a dielectric filter having at least one resonator unit, said apparatus comprising:

an electric parameter measuring device which extracts a plurality of electric parameters for said at least one resonator unit by measuring characteristic parameters of a dielectric filter whose characteristics are to be adjusted, and transforms the characteristic parameters into said electric parameters by a fitting calculation with respect to a designed equivalent circuit of the filter;

an adjustment device which adjusts each of a plurality of electric parameter adjusting portions of said at least one resonator unit of said dielectric filter, thus generating, with the use of the electric parameters obtained by the electric parameter measuring device and with the use of an adjusting amount, adjustment functions indicating a variation amount of the electric parameters with respect to the adjusting amount;

an adjusting amount calculating device which calculates the adjusting amount, in accordance with simultaneous equations involving the adjustment function, with the use of electric parameters obtained before the adjustment, and with the use of desired electric parameters; and an adjusting device which adjusts an amount calculated by the adjusting amount calculating device, a control device which controls the electric parameter measuring device, the adjusting amount calculating device, and the adjusting device, to perform repeated treatments upon the plurality of electric parameter adjusting portions of said at least one resonator unit of the dielectric filter until the characteristic parameters of the dielectric filter arrive at predetermined values.

3. A method of automatically adjusting the characteristics of a dielectric filter having at least one resonator unit, said method comprising the steps of:

extracting a plurality of electric parameters for said at least one resonator unit by measuring characteristic parameters of a dielectric filter whose characteristics are to be adjusted, and transforming the characteristic parameters into said electric parameters for said at least one resonator unit by a fitting calculation with respect to a designed equivalent circuit of the filter;

generating an adjustment function by adjusting each of a plurality of electric parameter adjusting portions of said at least one resonator unit of said dielectric filter, thus generating, with the use of the extracted electric parameters and with the use of an adjusting amount, adjustment functions indicating a variation amount of the electric parameters with respect to the adjusting amount;

calculating said adjusting amount in accordance with simultaneous equations involving the adjustment function, with the use of electric parameters obtained before the adjusting step and with the use of desired electric parameters; and adjusting an amount calculated in the adjusting amount calculating step, wherein the electric parameter extracting step and the adjusting amount calculating step are repeatedly carried out for said plurality of electric parameter adjusting portions of said at least one resonator unit until the characteristic parameters of the dielectric filter arrive at predetermined values.

4. The method of automatically adjusting the characteristics of a dielectric filter according to claim 3, wherein the dielectric filter is a multiple mode dielectric filter.

5. The method of automatically adjusting the characteristics of a dielectric filter according to claim 3, wherein said electric parameters obtained before the adjustment, during a first time adjustment, are obtained by an electric parameter measurement device, and said electric parameters, during adjustments from a second time adjustment onward, are obtained by incorporating into the simultaneous equations involving the adjustment functions, the electric parameters obtained in the electric parameter extracting step after a previous adjustment, and an already-adjusted amount, followed by an inverse calculation.

6. The method of automatically adjusting the characteristics of a dielectric filter according to claim 5, wherein the dielectric filter is a multiple mode dielectric filter.

7. A method of automatically adjusting the characteristics of a dielectric filter, said method comprising the steps of:

extracting electric parameters by measuring characteristic parameters of a dielectric filter whose characteristics are to be adjusted, and transforming the characteristic parameters into said electric parameters by a fitting calculation with respect to a designed equivalent circuit of the filter;

generating an adjustment function by adjusting electric parameter adjusting portions of said dielectric filter, thus generating, with the use of the extracted electric parameters and with the use of an adjusting amount, adjustment functions indicating a variation amount of the electric parameters with respect to the adjusting amount;

calculating said adjusting amount in accordance-with simultaneous equations involving the adjustment function, with the use of electric parameters obtained before the adjusting step and with the use of desired electric parameters;

adjusting an amount calculated in the adjusting amount calculating step, wherein the electric parameter extracting step and the adjusting amount calculating step and the adjusting step are repeatedly carried out until the characteristic parameters of the dielectric filter arrive at predetermined values, and wherein in the adjusting amount calculating step, the adjusting amount is calculated by multiplying a calculation result with a predetermined ratio, the calculation result being obtained by incorporating into the simultaneous equations involving the adjustment functions, the electric parameters obtained in the electric parameter extracting step and the desired electric parameters.

8. The method of automatically adjusting the characteristics of a dielectric filter according to claim 7, wherein said electric parameters obtained before the adjustment, during a first time adjustment, are obtained by an electric parameter measurement device, and said electric parameters, during adjustments from a second time adjustment onward, are obtained by incorporating into the simultaneous equations involving the adjustment functions, the electric parameters obtained in the electric parameter extracting step after a previous adjustment, and an already-adjusted amount, followed by an inverse calculation.

9. The method of automatically adjusting the characteristics of a dielectric filter according to claim 8, wherein the dielectric filter is a multiple mode dielectric filter.

10. A method of automatically adjusting the characteristics of a dielectric filter, said method comprising:

a step for extracting electric parameters of a dielectric filter whose characteristics are to be adjusted, and transforming the characteristic parameters into said electric parameters by a fitting calculation with respect to a designed equivalent circuit of the filter;

a step for generating an adjustment function, and thus generating, with the use of the extracted electric parameters and with the use of an adjusting amount, adjustment functions indicating a variation amount of the electric parameters with respect to the adjusting amount;

a step for calculating said adjusting amount in accordance with simultaneous equations involving the adjustment function, with the use of electric parameters obtained before the adjusting step and with the use of desired electric parameters; and a step for adjusting an amount calculated in the adjusting amount calculating step, wherein the electric parameter extracting step and the adjusting amount calculating step and the adjusting step are repeatedly carried out until the characteristic parameters of the dielectric filter arrive at predetermined values, wherein in the adjusting amount calculating step, the adjusting amount is calculated, the calculation result being obtained by incorporating into the simultaneous equations involving the adjustment functions, the electric parameters obtained in the electric parameter extracting step and the desired electric parameters, wherein said electric parameters obtained before the adjustment, during a first time adjustment, are obtained by an electric parameter measurement device, and wherein said electric parameters, during adjustments from a second time adjustment onward, are electric parameters obtained by incorporating into the simultaneous equations involving the adjustment functions, the electric parameters obtained in the electric parameter extracting step after a previous adjustment, and an already-adjusted amount, followed by an inverse calculation.

11. The method of automatically adjusting the characteristics of a dielectric filter according to claim 10, wherein the dielectric filter is a multiple mode dielectric filter.

12. A method of automatically adjusting the characteristics of a dielectric filter, said method comprising:

a step for extracting electric parameters of a dielectric filter whose characteristics are to be adjusted, and transforming the characteristic parameters into said electric parameters by a fitting calculation with respect to a designed equivalent circuit of the filter;

a step for generating an adjustment function, and thus generating, with the use of the extracted electric parameters and with the use of an adjusting amount, adjustment functions indicating a variation amount of the electric parameters with respect to the adjusting amount;

a step for calculating said adjusting amount in accordance with simultaneous equations involving the adjustment function, with the use of electric parameters obtained before the adjusting step and with the use of desired electric parameters;

a step for adjusting an amount calculated in the adjusting amount calculating step, wherein the electric parameter extracting step and the adjusting amount calculating step and the adjusting step are repeatedly carried out until the characteristic parameters of the dielectric filter arrive at predetermined values;

wherein said electric parameters obtained before the adjustment, during a first time adjustment, are obtained by an electric parameter measurement device; and wherein said electric parameters, during adjustments from a second time adjustment onward, are obtained by incorporating into the simultaneous equations involving the adjustment functions, the electric parameters obtained in the electric parameter extracting step after a previous adjustment, and an already-adjusted amount, followed by an inverse calculation.

13. The method of automatically adjusting the characteristics of a dielectric filter according to claim 12, wherein the dielectric filter is a multiple mode dielectric filter.

14. A method of automatically adjusting the characteristics of a dielectric filter having at least one resonator unit, said method comprising:

a step for extracting a plurality of electric parameters of said at least one resonator unit by measuring characteristic parameters of a dielectric filter whose characteristics are to be adjusted, and transforming the characteristic parameters into said electric parameters for said at least one resonator unit by a fitting calculation with respect to a designed equivalent circuit of the filter;

a step for generating an adjustment function for adjusting each of a plurality of electric parameter adjusting portions of said at least one resonator unit, and thus generating, with the use of the extracted electric parameters and with the use of an adjusting amount, adjustment functions indicating a variation amount of the electric parameters with respect to the adjusting amount;

a step for calculating said adjusting amount in accordance with simultaneous equations involving the adjustment function, with the use of electric parameters obtained before the adjusting step and with the use of desired electric parameters; and a step for adjusting an amount calculated in the adjusting amount calculating step, wherein the electric parameter extracting step and the adjusting amount calculating step and the adjusting step are repeatedly carried out for said plurality of electric parameter adjusting portions of said at least one resonator unit until the characteristic parameters of the dielectric filter arrive at predetermined values.

15. The method of automatically adjusting the characteristics of a dielectric filter according to claim 14, wherein in the adjusting amount calculating step, the adjusting amount is calculated, the calculation result being obtained by incorporating into the simultaneous equations involving the adjustment functions, the electric parameters obtained in the electric parameter extracting step and the desired electric parameters.

16. The method of automatically adjusting the characteristics of a dielectric filter according to claim 14, wherein the dielectric filter is a multiple mode dielectric filter.

* * * * *